US006994212B2

(12) United States Patent
Bar Noy

(10) Patent No.: US 6,994,212 B2
(45) Date of Patent: Feb. 7, 2006

(54) APPARATUS FOR STORING

(76) Inventor: Gideon Bar Noy, Harav Kuk 40/17, Kiriat Motzkin (IL) 26360

( * ) Notice: Subject to any disclaimer, the term of this patent is extended or adjusted under 35 U.S.C. 154(b) by 358 days.

(21) Appl. No.: 10/386,720

(22) Filed: Mar. 13, 2003

(65) Prior Publication Data

US 2004/0178087 A1 Sep. 16, 2004

(51) Int. Cl.
*B65D 83/10* (2006.01)

(52) U.S. Cl. ..... 206/362.2; 206/209.1

(58) Field of Classification Search ..... 206/208, 206/209, 209.1, 361, 362, 362.1, 362.2, 362.3, 206/364, 365, 368; 312/206, 207; D6/528, D6/534

See application file for complete search history.

(56) References Cited

U.S. PATENT DOCUMENTS

| | | | | | |
|---|---|---|---|---|---|
| 1,803,194 | A | * | 4/1931 | Kennedy | 206/209.1 |
| 3,727,748 | A | * | 4/1973 | Brown | 206/362.1 |
| 3,881,868 | A | * | 5/1975 | Duke | 206/209.1 |
| 3,884,635 | A | * | 5/1975 | Sloan | 206/209.1 |
| 4,214,657 | A | * | 7/1980 | Winston | 206/209.1 |
| 4,854,457 | A | | 8/1989 | Perler | 211/65 |
| 4,915,219 | A | * | 4/1990 | Ottimo | 206/209.1 |
| 5,522,497 | A | | 6/1996 | Stacy | 206/209.1 |
| D389,686 | S | | 1/1998 | Drage | D6/528 |
| 5,984,100 | A | * | 11/1999 | Ramsey et al. | 206/581 |
| 6,119,854 | A | | 9/2000 | Prentice et al. | 206/209.1 |
| 6,135,279 | A | | 10/2000 | Dryer | 206/362.1 |
| 6,155,411 | A | * | 12/2000 | Ho | 206/77.1 |
| 6,186,324 | B1 | * | 2/2001 | Catterson | 206/362.1 |
| D440,090 | S | | 4/2001 | Lillelund et al. | D6/534 |
| D454,740 | S | | 3/2002 | Baggott | D6/534 |

FOREIGN PATENT DOCUMENTS

| | | |
|---|---|---|
| DE | 19925362 | 10/2000 |

* cited by examiner

*Primary Examiner*—Kurt Fernstrom
(74) *Attorney, Agent, or Firm*—Blank Rome LLP

(57) ABSTRACT

An apparatus for storing various items, like toothbrushes, toothpaste tubes, razors or other toiletry and non-toiletry items. The apparatus comprises a carrier member adapted to accommodate the said items therein and a support member adapted to support the carrier member. The carrier member is separable from the support member and receivable thereinto. The carrier member is configured as a body of rotation defined by a longitudinal axis, by an upper portion, by an elongated tubular peripheral portion and by a lower portion. The carrier member and the support member are provided with a respective abutment means enabling resting of the carrier member on the support member. At least the carrier member is provided with a ventilation means and with drainage means to enable sanitary storage of the items. Both the carrier member and the support member can be used as a single standalone item suitable for sanitary storage.

19 Claims, 17 Drawing Sheets

SECTION B-B

SECTION B-B

SECTION B-B

SECTION B-B

SECTION B-B

APPARATUS FOR STORING

BACKGROUND OF THE INVENTION

1. Field of the Invention

The present invention relates to devices for holding of various items like toothbrushes, toothpaste tubes, razors and other toiletry items.

More particularly the invention refers to receptacles, which allow convenient and sanitary storage of wet items, which holding might be associated with formation of mold due to accumulating of moisture, with untidy appearance and even with the possibility of contamination by germs and bacteria.

It should be born in mind, however, that the present invention is not limited merely to holding of the above-listed items and that within the scope of the present invention are apparatuses suitable for holding of any other items, which are not necessary toiletry items.

2. Description of the Related Art

Although holder for toothbrushes or toiletry accessories is a very simple item, which is known since the mankind began using of toothbrush, nevertheless there still exist endless attempts to devise new toothbrush holders, which would provide more efficient and sanitary storage, which would have more pleasant and fancy external appearance, which would be suitable for traveling, which would be made of new plastics or of other materials, etc. Accordingly, many patents exist in the art, which refer to this subject. Due to its high popularity the existing patent classifications include special classes dedicated to toothbrush holders. In particular, class A47k1/09 of the International Patent Classification is devoted to holders for drinking glasses, toothbrushes, hair brushers or the like and classes D6/528 and D6/534 of the US patent classification are devoted especially to toothbrush holders. Relatively superficial computerized patent search in class A47k1/09 when conducted in publicly available Internet site Espacenet would retrieve about 900 records referring to toothbrush holders. Similar search in class D6/528 or D6/534 when conducted in the official USPTO site would retrieve about 400 records, referring to US utility and design patent issued on toothbrush holders. From this list one can learn, for example, that the earliest retrievably patent concerning toothbrush holder was issued in the USA already in 1894. The known in the art toothbrush holders could be tentatively divided into two large groups. The first one refers to those, in which toothbrushes are stored generally on holders having apertures or recesses for securable receiving the handles of the toothbrushes. Some examples of such holder include U.S. Pat. No. 4,854,457, U.S. Pat. No. D454,740, and DE 19925362. The disadvantage of this type of holders is associated with the fact that the bristles of the toothbrush rest on the support surfaces, which are not always clean and this might cause disease transmission, unless special attention is paid to cleaning and sterilizing the toothbrush holders.

The second group refers to holders, in which the toothbrush is stored within a closed or open receptacle. The receptacle may stay on the cabinet sink or be supported by an integral or separable support structure. A cover provided with openings for insertion the toothbrush might close the receptacle.

For example, in U.S. Pat. No. 1,803,194 is described toothbrush holder, which comprises a storage receptacle with removable cover. In the storage receptacle is disposed a bracket for supporting the brushes stored and also is deployed an auxiliary container for an antiseptic. The auxiliary container is provided with openings for communication with the interior of the storage container adjacent the brushes. By virtue of this provision sanitary storage of the brushes is possible despite the storage container is closed and despite there is no drainage provided for evacuation of water droplets brought in the container with the brushes. The disadvantage of this holder is associated with its relatively complicate construction, requiring special bracket and separate container for storing the antiseptic.

In U.S. Pat. No. 3,727,748 is disclosed toothbrush holder, in which a number of brushes are hung in a closed container. The container is provided with a brush support and a lifter for lifting the brushes. The lifter is formed with lower plate for supporting brushes when they are lifted. The disadvantage of this holder is associated with its complicate design and with unsanitary storage, since the container is closed and no means is provided for evacuation of moisture accumulating on the lower plate.

Another example of holder provided with container for storing brushes is described in U.S. Pat. No. 5,522,497. This container is suitable for holding a tube of toothpaste along with a plurality of toothbrushes. The container is supported by a base member and there is provided a space between the housing body and the base member for airflow into the container. By virtue of this space the container is vented to allow the toothbrushes to air dry. Nevertheless, this holder also has rather complicated construction and is not provided with a possibility for draining the accumulated moisture.

Very typical examples of a holder, designed as a receptacle are presented in U.S. Pat. No. D389,686 and in U.S. Pat. No. D440,090. These holders are configured as a body, in which elongated cavities are provided for nesting of toothbrushes and of toothpaste tube. The holders however are neither with openings for venting nor with possibility for drainage.

In U.S. Pat. No. 6,135,279 is described sanitizing toothbrush holder, which comprises a container having at least a pair of compartments for receiving removable platforms, on which the toothbrushes heads rest. The compartments contain an antiseptic material to sanitize the bristles of the brushes, when they are brought on platforms down. The platforms are connected by downwardly extending rod-like members to a closure of the container.

In U.S. Pat. No. 6,119,854 is described sanitary toothbrush storage unit comprising an upper chamber, a removable reservoir supported under the upper chamber and adapted to hold a sanitizing liquid, a middle divider mounted between the reservoir and the upper chamber and a cover adapted for opening and closing the upper chamber. The middle divider has a hole for insertion a toothbrush such that the bristle end rests in the reservoir and the handle extends into the upper chamber.

The concept of the two last holders is similar and so their common disadvantage associated with complicated construction, which renders the holders inconvenient in use due to necessity on replacement of the sanitizing liquid.

The list of examples, in which the above container concept is implemented, could be continued further.

In conclusion it should be emphasized that despite the fact that numerous devices for storage of toothbrushes and other toiletry items have been devised there still exists a room for a new and improved device

OBJECTS OF THE INVENTION

The main object of the present invention is to provide a new and improved storage apparatus, which is suitable for sanitary and hygienic storage of toiletry and other items by virtue of evacuation of moisture associated with the stored items.

Still further object of the present invention is to provide a new and improved storage apparatus, which has attractive and esthetic appearance.

Yet another object of the invention is to provide a new storage apparatus, which has extremely simple construction, is inexpensive in fabrication and convenient in use and maintenance.

The above and other objects and advantages of the present invention can be achieved in accordance with the following combination of its essential features.

An apparatus for storing various items, like toothbrushes, toothpaste tubes, razors or other toiletry and non-toiletry items, said apparatus comprising a carrier member adapted to accommodate the said items therein and a support member adapted to support the carrier member; said carrier member is separable from the support member and insertable thereinto, said carrier member is configured as a body of rotation defined by a longitudinal axis, by an upper portion, by an elongated tubular peripheral portion and by a lower portion; said upper portion is open to enable placement of the items in the carrier member; said carrier member and said support member are provided with a respective abutment means enabling resting of the carrier member on the support member; and at least the carrier member is provided with a ventilation means and with a drainage means to enable sanitary storage of the items.

In accordance with an alternative embodiment of the present invention it can be implemented also as a single, standalone storage item suitable for storing various items, like toothbrushes, toothpaste tubes, razors or other toiletry and non-toiletry items. This single item can be designed as a carrier member configured as a body of rotation defined by a longitudinal axis, by an upper portion, by an elongated tubular peripheral portion and by a lower portion, said upper portion is open to enable placement of the items in the carrier member and is configured as a truncated cone tapering downwardly to adjoin the peripheral portion; the lower portion of the carrier member is provided with a bottom for resting the stored items thereon and it is designed for enabling steady positioning of the carrier member on a horizontal plane; said carrier member is provided with a plurality of perforations and with a drainage means to enable sanitary storage of the items.

In accordance with an alternative embodiment the single storage item can be configures as a support member comprising:

- several legs, each of them being defined by an upper extremity, by a leg body portion and by a lower extremity
- a ring-like neck portion, adjoining the upper extremities of the legs,
- a lowermost portion, consisting of an internal wall, adjoining the inwardly facing surfaces of the legs lower extremities and an external wall, which is concentric with the internal wall and which adjoins the outwardly facing surfaces of the legs lower extremities, said lowermost portion is designed to enable steady positioning of the support member on a horizontal plane,
- a cup means providing a floor for resting the stored items thereon, said cup means is suitable for collecting moisture associated with the items and is provided with a drainage means to enable sanitary storage of the items.

The present invention in its various embodiments has only been summarized briefly. For better understanding of the present invention as well of its advantages, reference will now be made to the following description of its embodiments with reference to the accompanying drawings.

DETAILED DESCRIPTION OF THE PREFERRED EMBODIMENTS

The present invention is mainly directed to sanitary, convenient and esthetic storage of toothbrushes, razors and other toiletry and non-toiletry items, which have long size and which might carry droplets of water on them.

Figure 1:
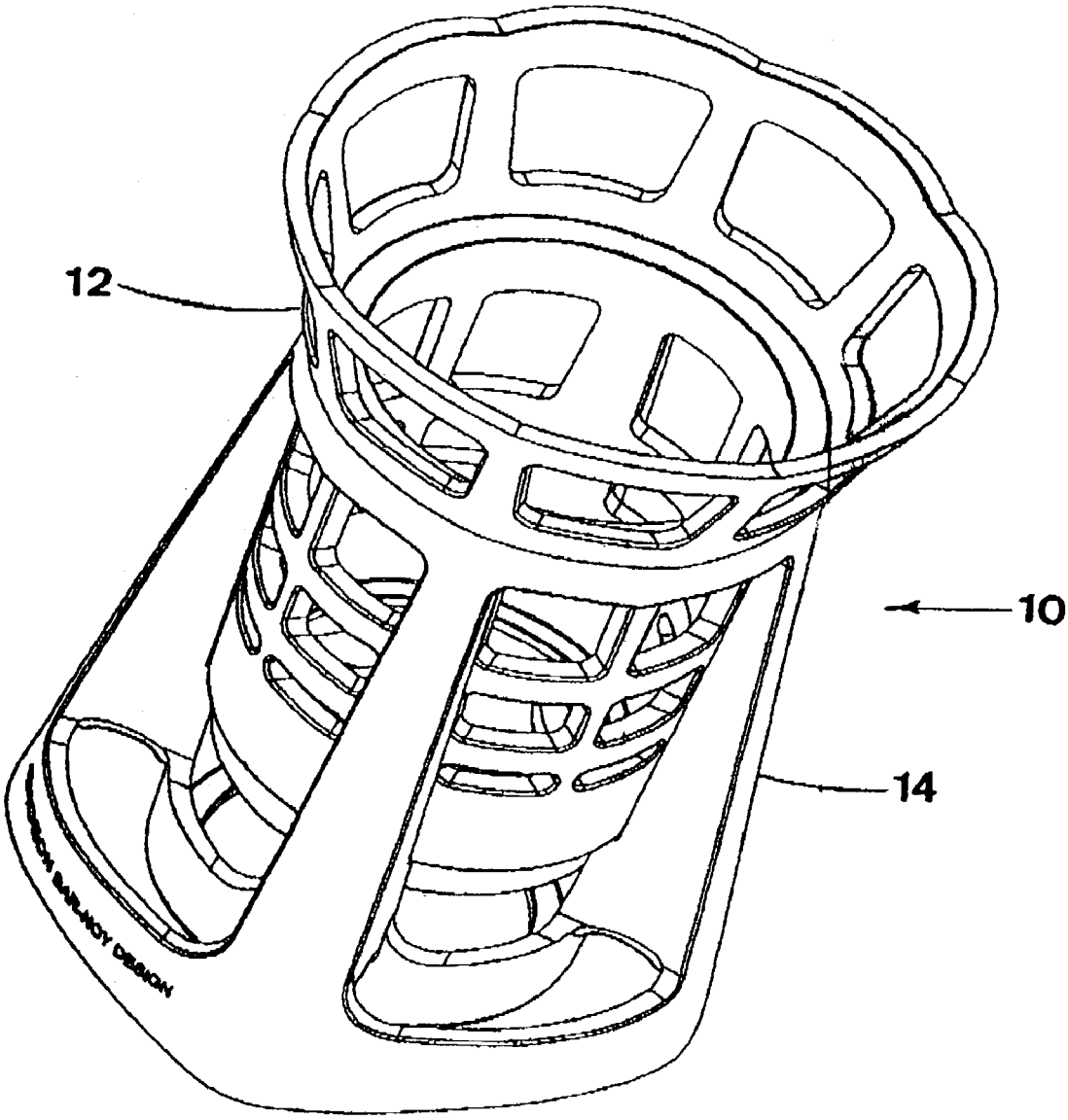
FIG. 1 is a three-dimensional view of the storage apparatus of the invention in accordance with its main preferred embodiment.
Figure 2:
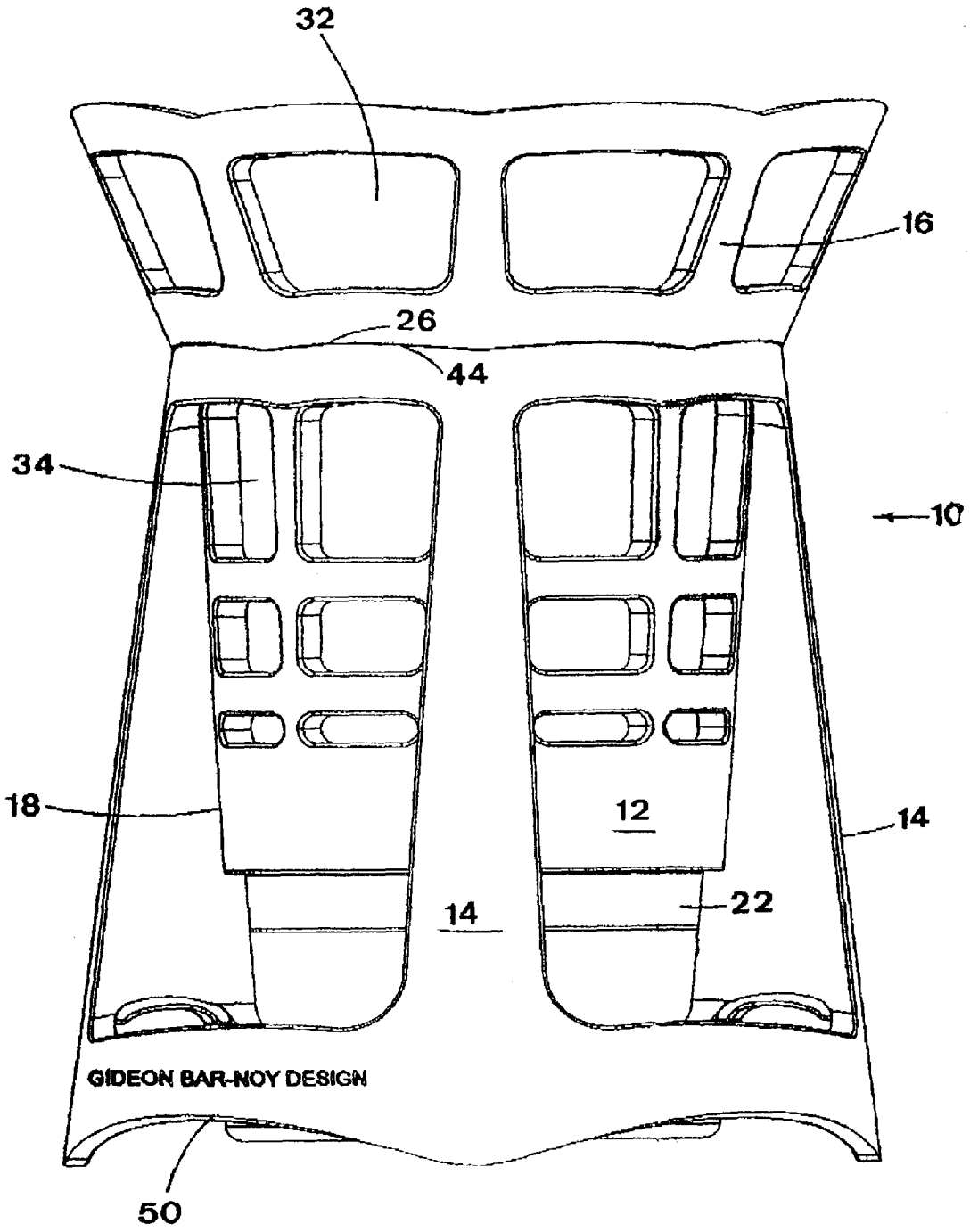
FIG. 2 shows a front view of the storage means depicted in FIG. 1.
Figure 3:
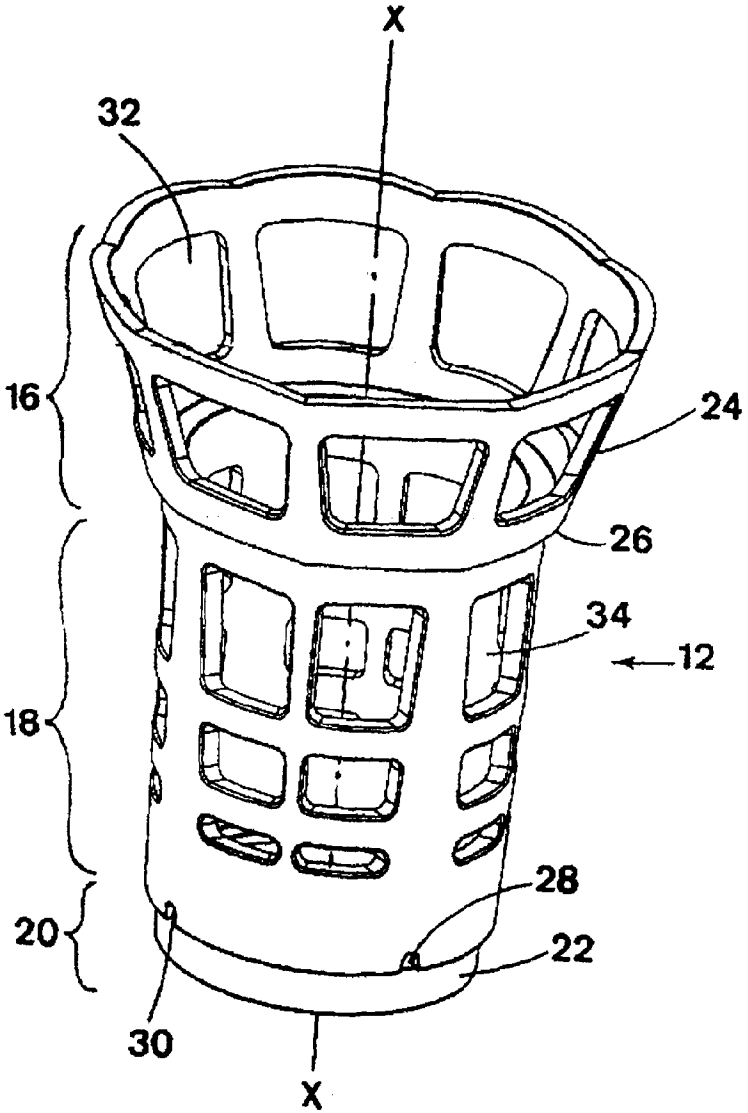
FIGS. 3, 4 are respective views of a carrier member and a support member employed in the embodiment shown in FIG. 1.
Figure 4:
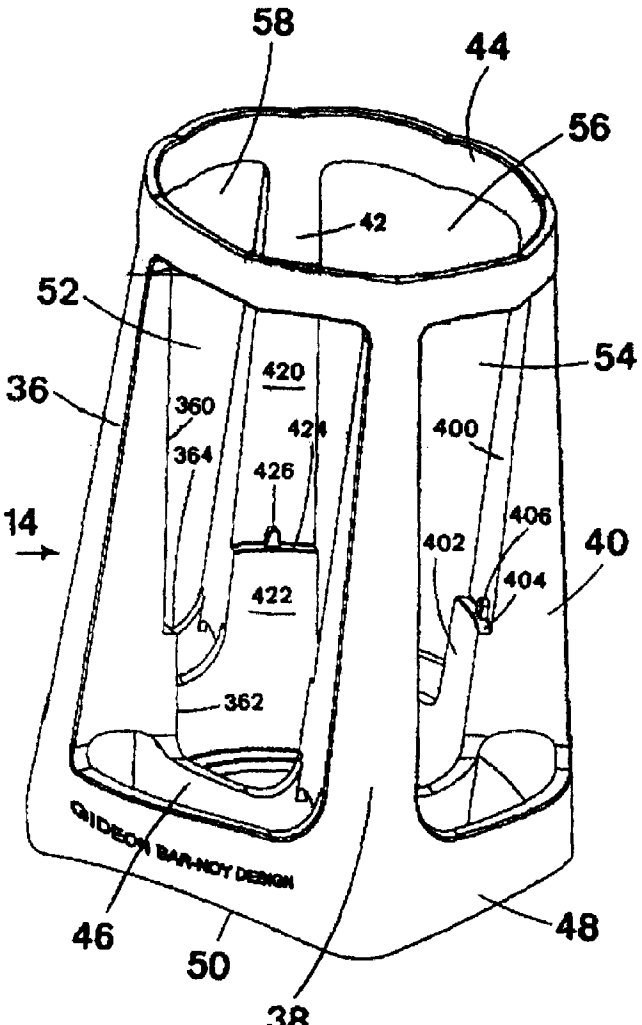

Referring to FIGS. 1,2 it is shown schematically a storage apparatus 10 of the invention in accordance with its main embodiment. In this embodiment the apparatus comprises two separate members, i.e. a carrier member 12 and a support member 14, which can be assembled together in a single unit when the apparatus is to be in use. To assemble the apparatus the carrier member is made easily insertable into support member so that upon insertion it rests steady on the support member. At the same time the carrier member can be simply withdrawn when the members are to be separated, for example if it is required to clean them. The members in a separate state are depicted in FIG. 3 and FIG. 4. The carrier member is adapted for accommodating the stored items therein and accordingly it is designed as a body of rotation defined by a longitudinal axis X—X, by an open upper portion 16, by an elongate tubular peripheral portion 18 and by a lower portion 20. The longitudinal dimension of the carrier member allows accommodating therein of long items, e.g. toothbrushes, toothpaste tubes etc.

It is seen in FIG. 3, that the peripheral portion of the carrier member is defined by an outside diameter, which is more than an outside diameter of the lower portion and thus there is provided an annular stepwise recess 22.

It is also seen, that the upper portion of the carrier member is configured as a truncated cone 24, which tapers downwardly to adjoin the uppermost extremity of the peripheral portion with formation of a circular shelf region 26, which outside diameter exceeds the outside diameter of the peripheral portion. The angle of the cone is selected to enables resting thereon of the stored items.

It is not shown in FIG. 3, but should be appreciated that the shelf region is configured as an undulated circular region. The significance of this configuration of the shelf region will be explained further.

Distributed along the lowermost extremity of the peripheral portion discrete female cavities 28,30 are provided, which together with the annular recess 22 enable nesting of the carrier member within the support member. Although in the embodiment shown in FIG. 3 only two such cavities are depicted it should be realized, however, that the rest of the cavities remain unseen and that in the embodiment shown in this figure there are provided altogether four such cavities separated from each other by 90 degrees. It should be realized, however, that the amount of cavities is not limited to four and depends on the size of the storage apparatus. In practice the amount of cavities may be any even or uneven number, which is less than four or more than four. In practice it is advantageous if the cavities are separated by an even interval to conform the rotational symmetry of the carrier member. The upper portion of the carrier member as well the peripheral portion thereof is perforated by a plurality of through holes 32,34, which have respectively trapezoidal and rectangle configuration. The holes made in the upper portion are of the same size, while the holes made in the peripheral portion are of dissimilar size, which diminishes towards the lower portion. It can be readily appreciated, that by virtue of the through holes efficient ventilation of the carrier member is allowed and thus wet items stored therein can air dry.

Referring to FIG. 4 construction of the support member will be now explained. The support member is configured as a frame, configured as a body having rotational symmetry with respect to a longitudinal axis, which coincides with the axis X—X, when the carrier member is received within the support member. The frame comprises four discrete vertical legs 36,38,40,42. The legs are separated therebetween by 90 degrees. In practice other number of legs is also possible, e.g. three or five. It is advantageous, however that the legs would be separated by an even interval to conform rotational symmetry. Each leg is formed with an upper extremity, with a leg body portion and with a lower extremity. The upper extremities of the legs adjoin a common ring-like neck portion 44. Formed on an inwardly facing side of each leg body portion a concave vertical wall and a stepwise concave protrusion is provided. In FIG. 4 are seen concave walls and protrusions referring to legs 36,40 and 42. These walls and protrusions are designated by respective reference numerals 360,362, 400,402 and 420,422.

It can be also seen, that each concave vertical wall adjoins the respective concave protrusion with formation a step. In FIG. 4 this step is seen on leg 36,40 and 42 and it is designated by respective reference numeral 364, 404 and 424.

The concavity of the walls mates the outside shape of the peripheral portion of the carrier member and the distance between the opposite concave walls slightly exceeds the outside diameter of the peripheral portion. By virtue of this provision the carrier member is easily receivable between the legs of the support member with possibility for axial displacement of the carrier member in the support member along the longitudinal axis X—X. It can be appreciated, that during axial displacement the concave vertical walls mating the peripheral portion provide radial support thereto.

Protruding upwardly from the central part of each step a discrete male pin is provided. In FIG. 4 only pins referring to steps 404 and 424 are seen and they are designated by respective reference numerals 406 and 426. The disposition and width of the steps as well the location and size of the associated pins is selected in such a manner that when the carrier member is inserted within the support member the annular recess 22 of the carrier member rests on the steps of the legs and each male pin of the support member enters into respective female cavity of the carrier member. By virtue of the annular recess 22 and female cavities of the carrier member and by virtue of the stepwise protrusions with male pins of the support member reliable abutment of the carrier member by the support member is provided resulting in steady resting of the carrier member on the support member without rotation about the longitudinal axis.

The upwardly facing side of the neck portion 44 is formed with undulated configuration, mating the undulated circular shelf region 26 of the carrier member. The height of the concave walls of the support member and the length of the peripheral portion of the carrier member are selected to enable resting of the undulated shelf region on the undulated neck portion when the carrier member rests on the support member. This arrangement renders the abutment between the carrier member and the support member more reliable.

As seen in FIG. 4 the outer sides of the legs are sloped towards the neck region 44. The lowermost extremities of the legs are connected therebetween by an inner wall 46 and by a concentric thereto an outer wall 48. It can bee seen that the inwardly facing sides of the legs adjoin the inner wall and the outwardly facing sides of the legs adjoin the outer wall. The inner wall has annular shape, which is congruent with the concave protrusions made in the legs. The outer wall has rounded shape constituted by the rounded outwardly facing sides of the legs. The lowermost side of the outer wall is shaped as an arch 50 bridging between the adjacent corners. This arched configuration of the outer wall can be better seen in FIG. 2. The lowermost side of the internal wall is above the corners and by virtue of this provision the support member can steadily base on the corners when it is positioned on a horizontal plane.

It is seen also that since the uppermost and the lowermost legs extremities adjoin the neck portion 44, the inner wall 46 and the outer wall 48 there are formed four large windows 52,54,56,58, which enable efficient ventilation of the support member. The widows in the support member together with the perforations made in the carrier member render drying of the stored items very fast.

Figure 5:
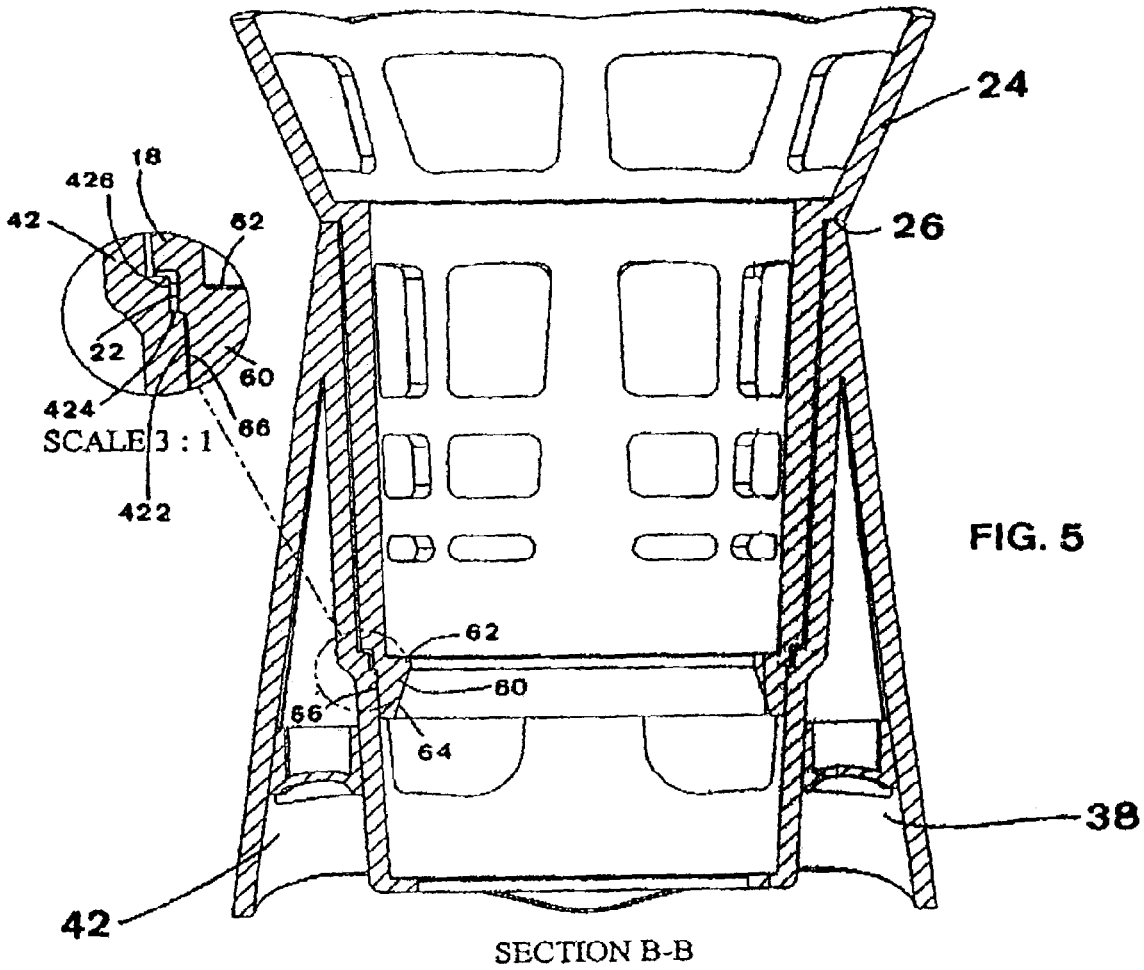
FIG. 5 is a cross-sectional view of the apparatus shown in FIG. 1.
Figure 6:
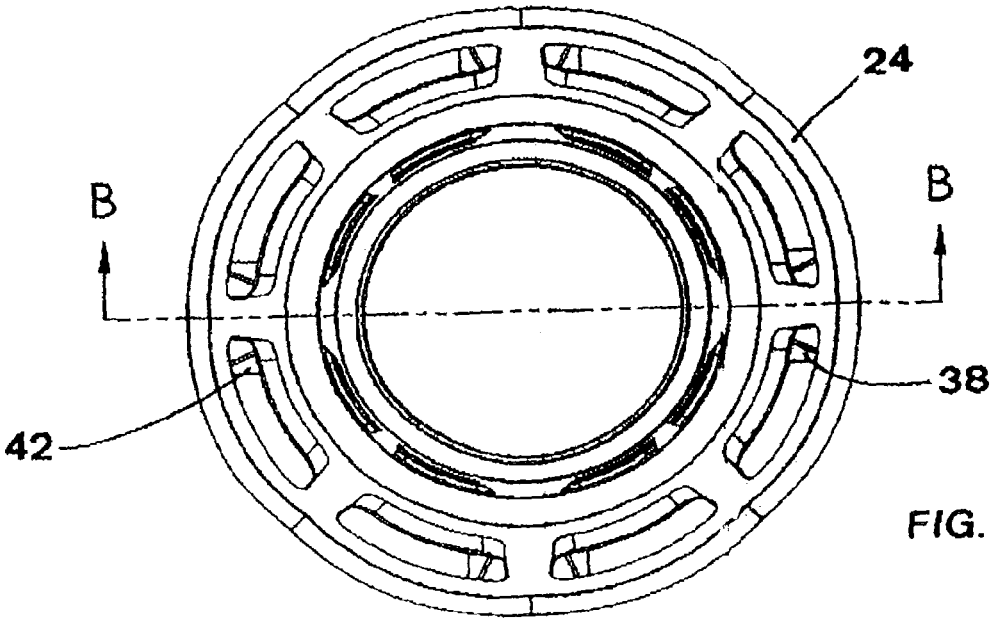
FIG. 6 is an upper view of the apparatus shown in FIG. 1.

Referring now to FIG. 5 it is seen that the lower portion of the carrier member is provided with an opened skirt 60, defined by an upper ring face 62, by an inner conical face 64 and by an outer cylindrical periphery region 66. Since the outside diameter of the periphery region is slightly less than the outside diameter of recess 22 there is provided a narrow step, connecting therebetween. When the carrier member is received in the support member this narrow step rests on the step provided between the concave wall and the concave protrusion formed on each leg of the support member. If one supposes that the designated in FIG. 6 cross-section B—B goes through legs 42 and 38 and that the encircled enlarged detail, shown in FIG. 5, refers to leg 42, than it is seen that the narrow step of the carrier member rests on step 424 between concave wall 420 and concave protrusion 422 of the support member. If, however the carrier member is withdrawn from the support member it can be steady positioned on the skirt, which provides a base for the carrier member. In this position the carrier member may serve as a standalone storage item, which does not require separate support member. This embodiment will be discussed in more details later on.

Figure 7:
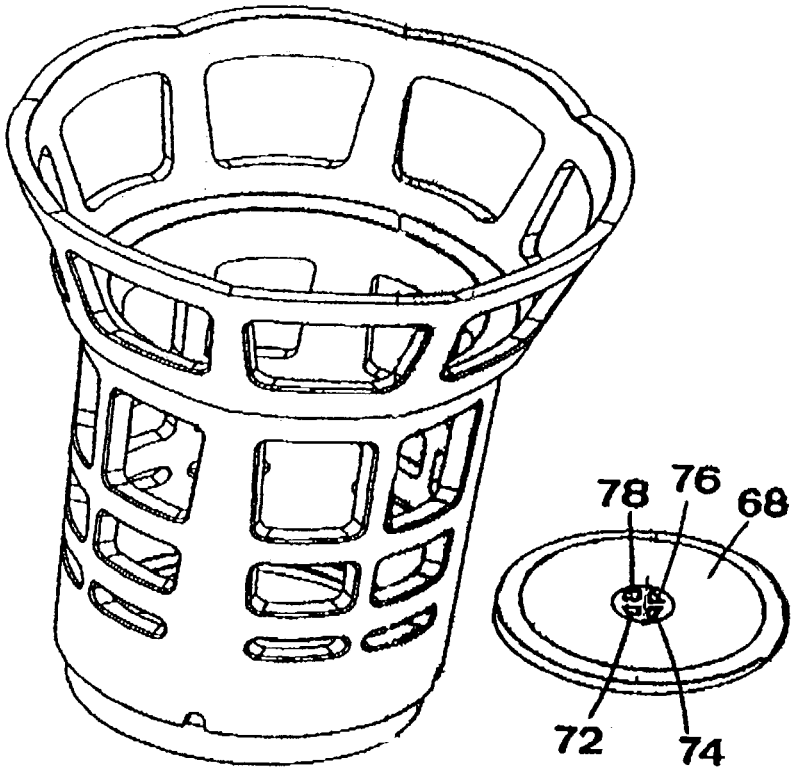
FIG. 7 is an exploded view of the apparatus shown in FIG. 1 with separate bottom and with separate cup means.
Figure 7:
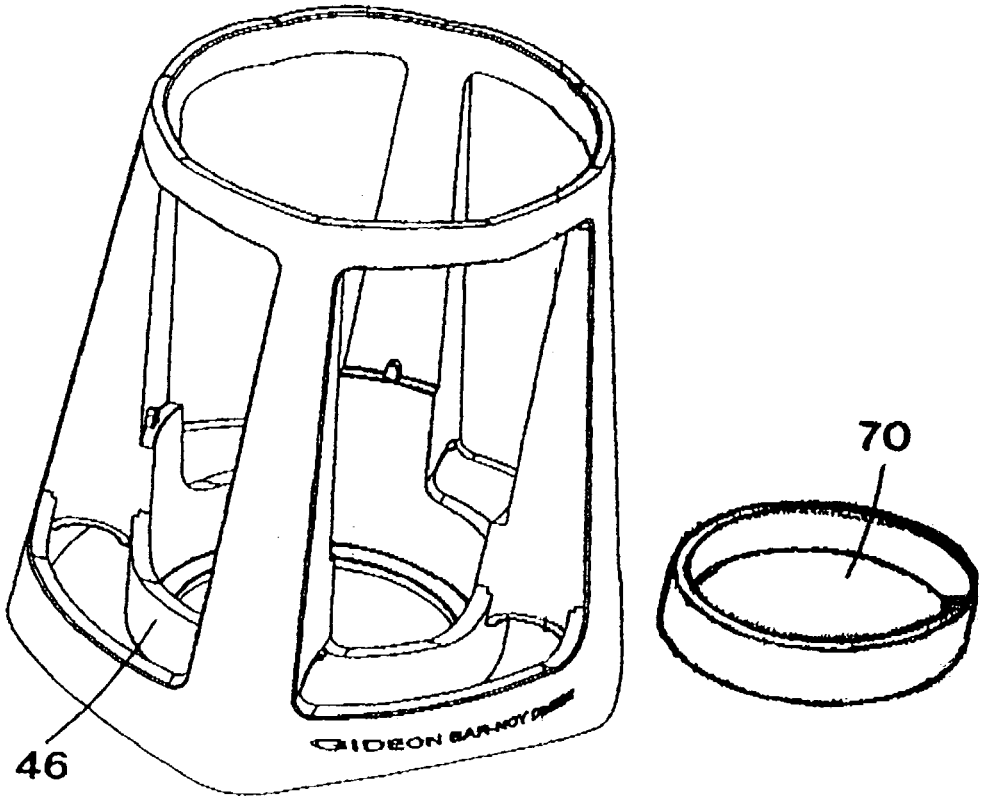

With reference to FIG. 7 a separate bottom 68 is shown near the carrier member and a separate cup means 70 near the support member. The separate bottom is insertable into carrier member to rest on the upper ring face 62 of the skirt and its function is to provide a floor for the items, stored in the carrier member. Situated in the central region of the bottom four through-going holes 72,74,76,78 are provided. Through these holes the moisture, dropping from the stored items on the bottom can be drained and evacuated by gravity from the carrier member.

The cup means is designed to be insertable into support member and to rest on an upwardly facing side of the internal wall. The function of the cup means is to receive moisture drained from the carrier member.

Figure 8:
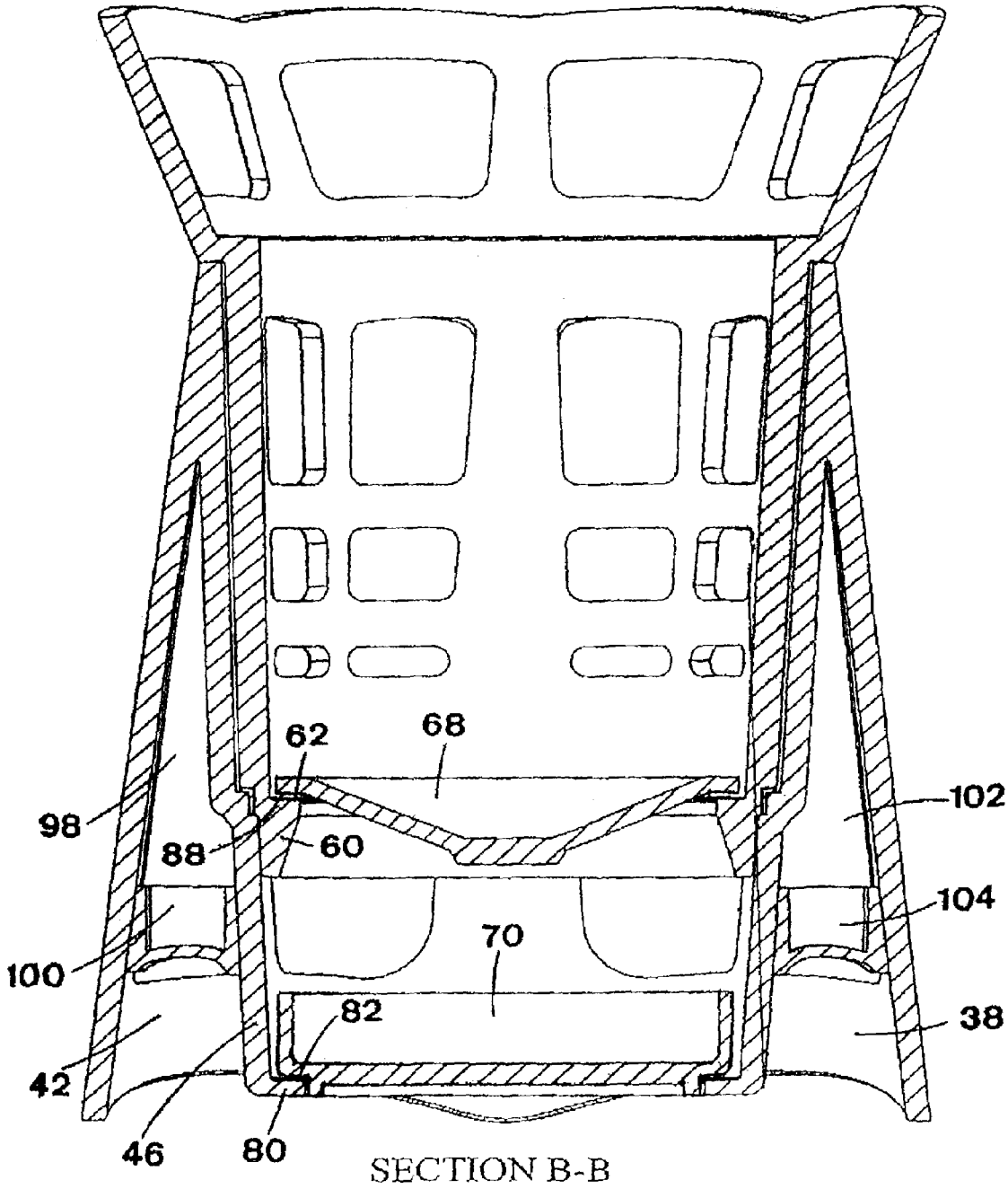
FIG. 8 is a cross-sectional view of the apparatus in accordance with the embodiment shown in FIG. 7.

The above-described situation, with the bottom resting on the skirt of the carrier member and the cup means resting on the inner wall of the support member is depicted in FIG. 8. In this embodiment the cup means is configured as a shallow container. It can be seen that the lowermost extremity of the internal wall 46 of the support member is provided with an annular shoulder 80, while in the outside periphery of the cup means is formed an annular recess 82 enabling resting of the cup means on the shoulder. It can be realized, that from time to time the apparatus can be disassembled and the cup means can be easily taken away from the support member for emptying thereof from the accumulated moisture. The separate parts of the apparatus can be conveniently washed and then easily assembled together again. In accordance with an alternative embodiment the cup means might be formed with through-going holes, through which the accumulated moisture can escape outside.

Now with reference to FIG. 9-12 the separate bottom and separate cup means will be described in more details.

Figure 9:
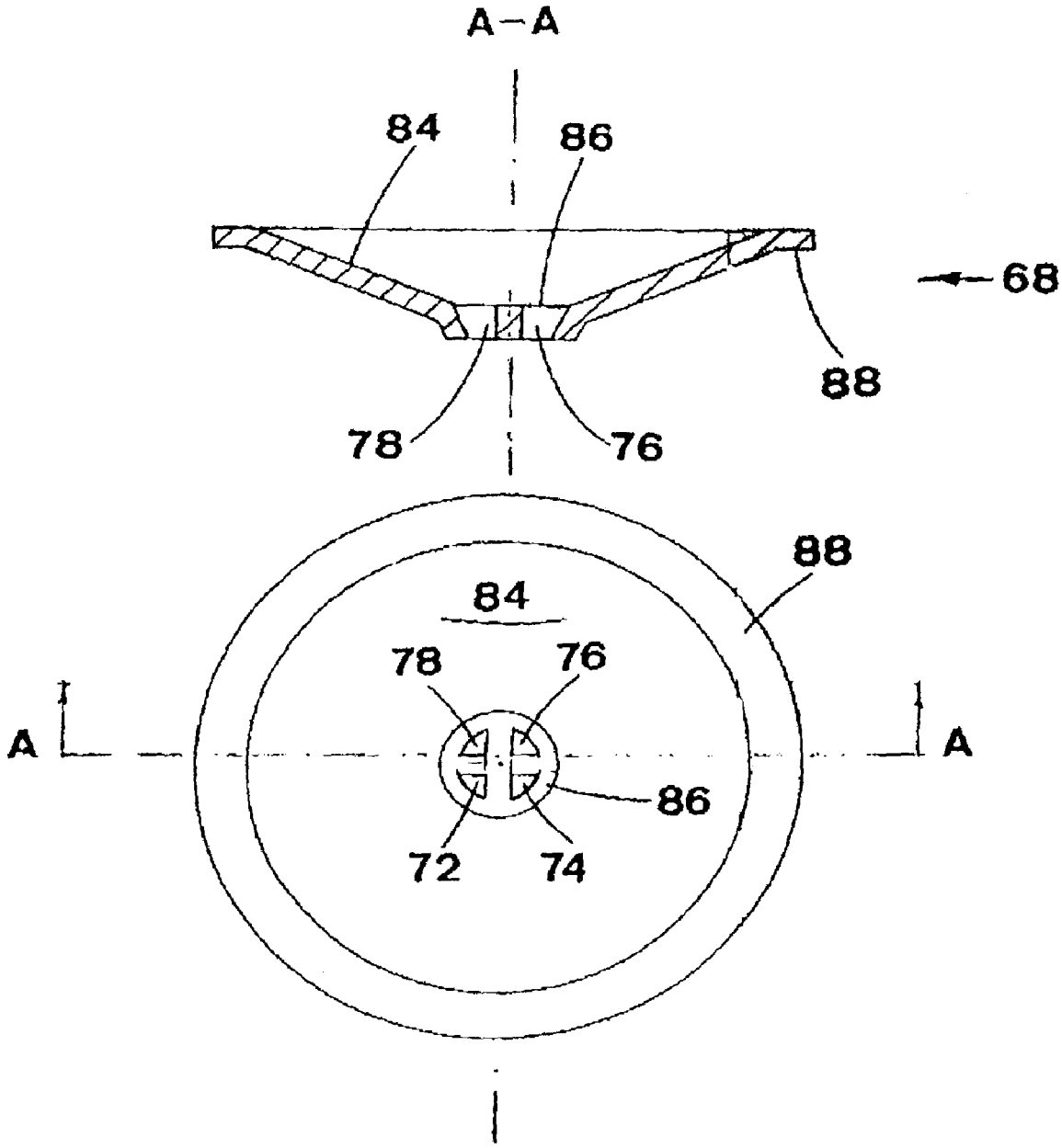
FIG. 9 presents an upper view and a cross-sectional view of a separate bottom.
Figure 10:
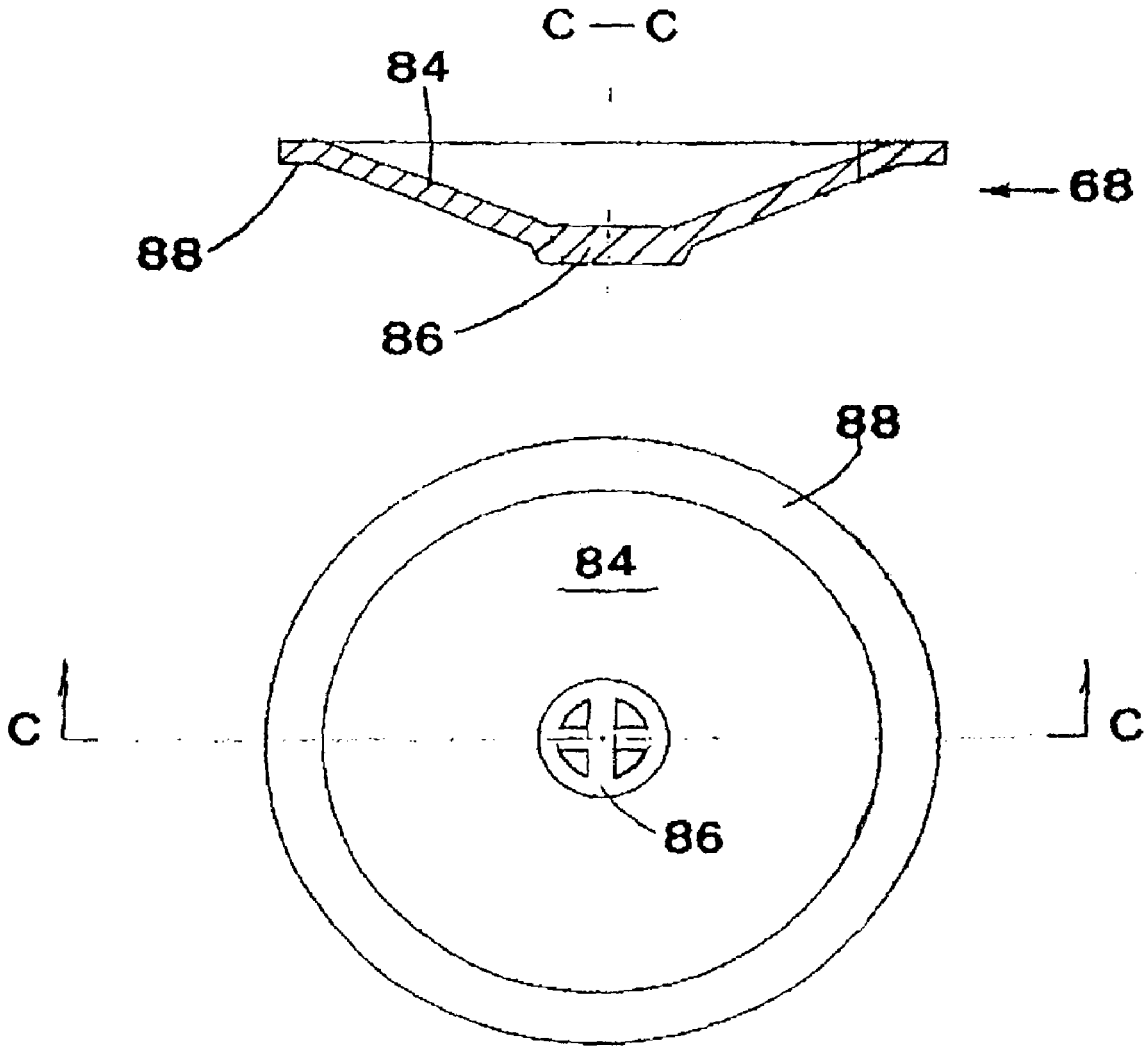
FIG. 10 present an additional upper and cross-sectional view of a separate bottom.

As best seen in cross-section A—A of FIG. 9 and cross-section C—C of FIG. 10 the bottom 68 is configured as a round saucer defined by an upper sloping rest face 84, by a central flat region 86 and by a horizontal margin 88. Made in the central region of the bottom four through-going drainage holes 72–78 are made. The holes are shown as having sectored shape, but it should be appreciated, that the holes could be of circular shape as well.

To facilitate draining of moisture the rest face tapers downwardly towards the central region and the sectored through-going holes are sloped. Two of the sloped holes, 76 and 78 are seen in FIG. 9. By virtue of margin 88 the bottom steadily rests on the upper ring face 62 of the skirt.

Figure 11:
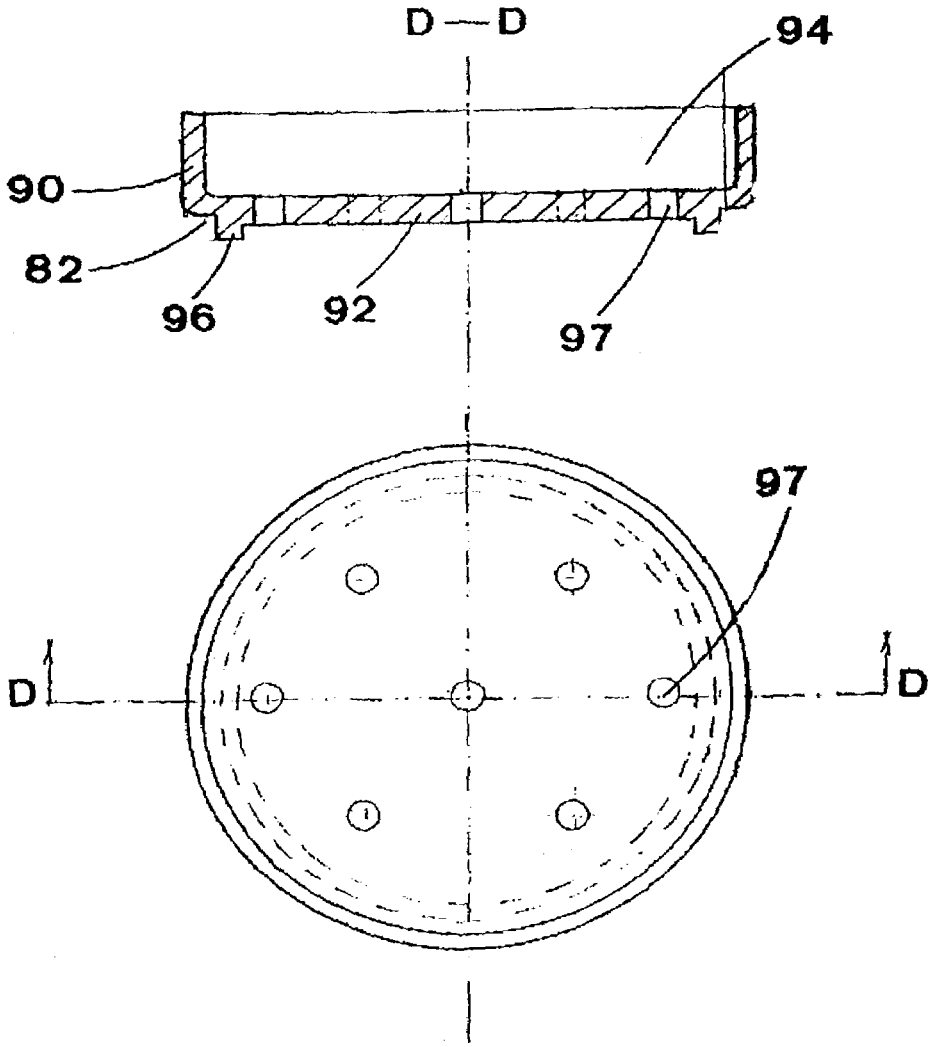
FIG. 11 presents an upper view and a cross-sectional view of a separate cup means.
Figure 12:
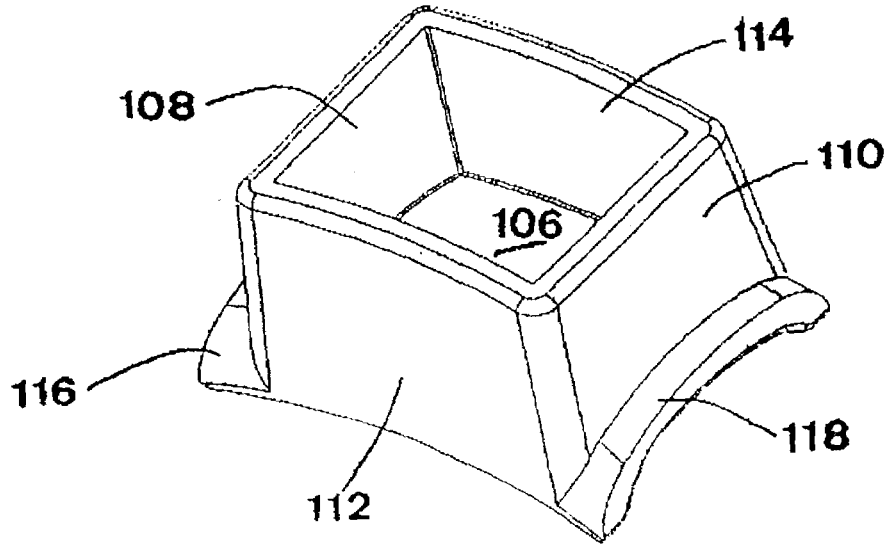
FIG. 12 is a three-dimensional view of a removable plug

In the embodiment shown in FIG. 11 the cup means is provided with holes for escape of moisture, while the other features are identical with those of the cup means without holes. As seen in cross-section D—D of FIG. 11 the cup means is configured as a shallow cup provided with an upright tubular wall 90 and a flat bottom 92, which mutually define an interior 94 of the cup. In the lower part of the cup there is provided an annular recess 82 and an annular protrusion 96. Several through holes are made in the bottom and one of them is designated by reference numeral 97.

As it has been already explained with reference to FIG. 8, the annular recess of the cup rests on the shoulder 80 of the support member. At the same time when the cup is outside the support member it rests on the annular protrusion 96.

By virtue of rotational symmetry of the carrier member and of the support member they can be easily manufactured e.g. by injection molding from thermosetting or thermoplastic organic materials. As an example of suitable organic materials one can mention commercially available inexpensive plastics like polypropylene, Acrylonitrile Butadiene Styrene, known as ABS, polycarbonate, polymethacrylate, polyethylene terephtalate or other suitable plastics. To provide the storage apparatus with more attractive and esthetical appearance the carrier member and the support member can be colored or translucent. The carrier member and the support member can be of the same or dissimilar material, be of the same color or made from plastic materials having dissimilar color.

Referring now again to cross-section B—B depicted in FIG. 8 an option for rendering the apparatus especially attractive and fancy appearance will be now discussed. This option can be materialized if at least the support member is made of a translucent material. As seen in FIG. 8 a space 98 is provided between the outwardly facing sloped side of leg 42 and the inwardly facing vertical side thereof. A removable plug 100 can seal this space. In FIG. 8 it is shown also that a similar space 102 is provided at the leg 38 and a similar removable plug 104 seals it. If now the plugs are removed and the legs are filled by a colored liquid medium and then sealed again then the colored medium will be seen through the leg walls, which creates attractive visual effect. To even more enhance this effect each leg can be filled with dissimilarly colored liquid medium. As best seen in FIG. 9 the plug is configured as an open quadrangle box, defined by a thin bottom 106 and by uprising thin walls 108,110,112, 114. The outwardly facing side of the wall 112 is sloped at an angle mating the slope of the outer sides of the legs. Two wide ears 116,118 extend from the opposite sides of the bottom at corresponding opposite walls 108,110. The plug is dimensioned to slightly exceed the space to be sealed and is made of a resilient material. The thickness of its walls is selected to enable sufficient resilient deformation required for reducing the size of the plug and insertion thereof in the space between the annular protrusion and the outer side of the leg. By virtue of resiliency the plug restores its size upon insertion and thus reliable seals the space. Convenient insertion and extraction of the plug is possible due to ears, which are graspable by hand and enable pushing to and pulling the plug from the space.

It can be readily appreciated that by virtue of abutment means provided at the carrier member and support member the storage apparatus of the invention can be easily assembled and disassembled for convenient maintenance. At the same time by virtue of ventilation and drainage means the apparatus avoids accumulation of moisture and averts formation of mold, thereby providing for sanitary and tidy storage. Since the carrier member and the support member are configured with rotational symmetry their convenient manufacture from commercially available inexpensive materials is possible. This configuration imparts also attractive and esthetical appearance.

Having explained the main embodiment of the invention, in which the bottom and the cup are separate elements let us consider additional embodiments of the present storage apparatus.

Figure 13:
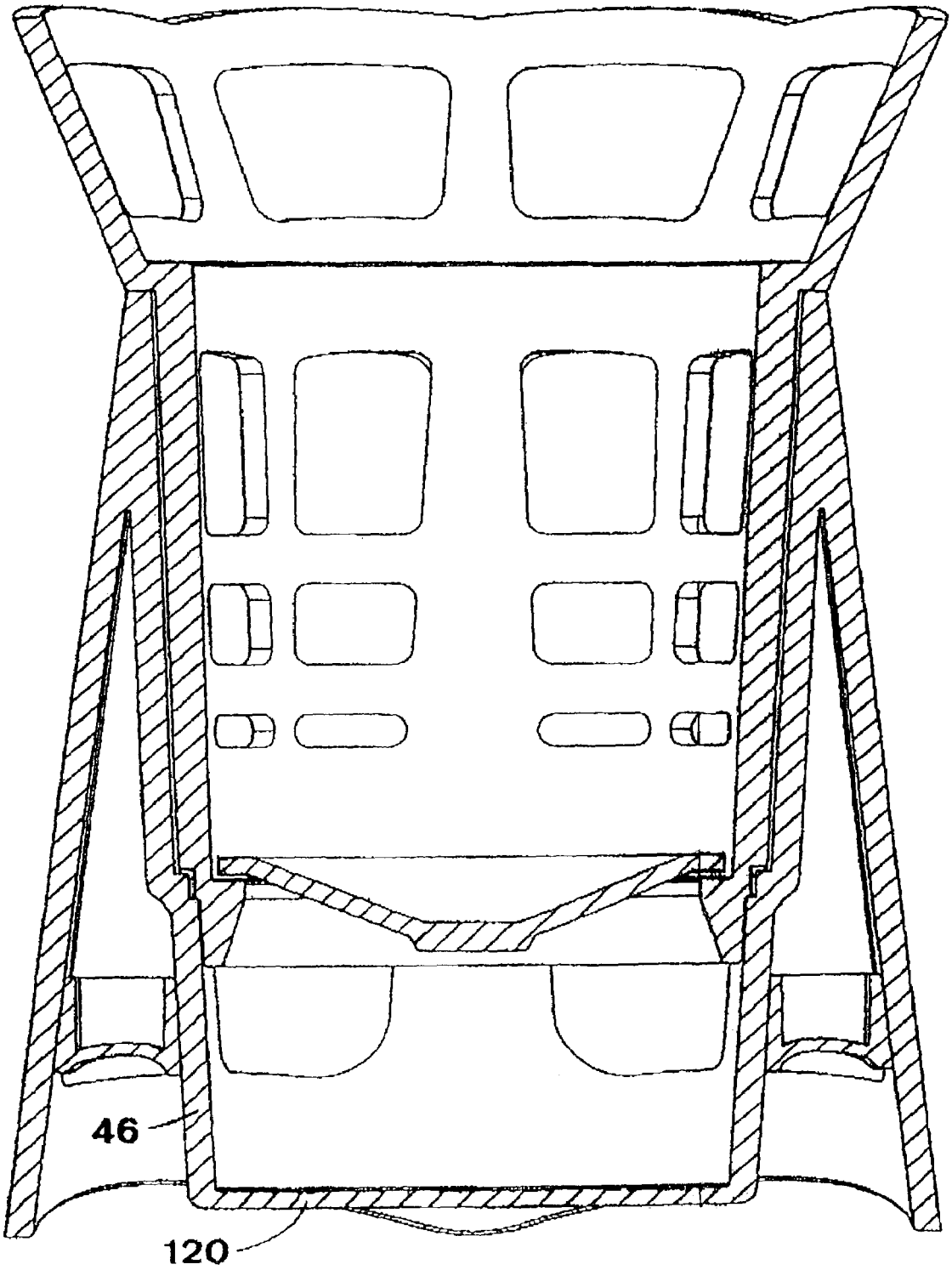
FIGS. 13–18 are cross-sectional views of the apparatus in accordance with additional embodiments.

Referring to FIG. 13 it is seen that the internal wall of the support member is provided with a floor 120 constituting a cup means, which is integral with the internal wall 46. Moisture drained from the carrier member will be received in the support member and accumulated on the floor. To evacuate the moisture it would be sufficient to turn over the support member when it is separated from the carrier member.

Figure 14:
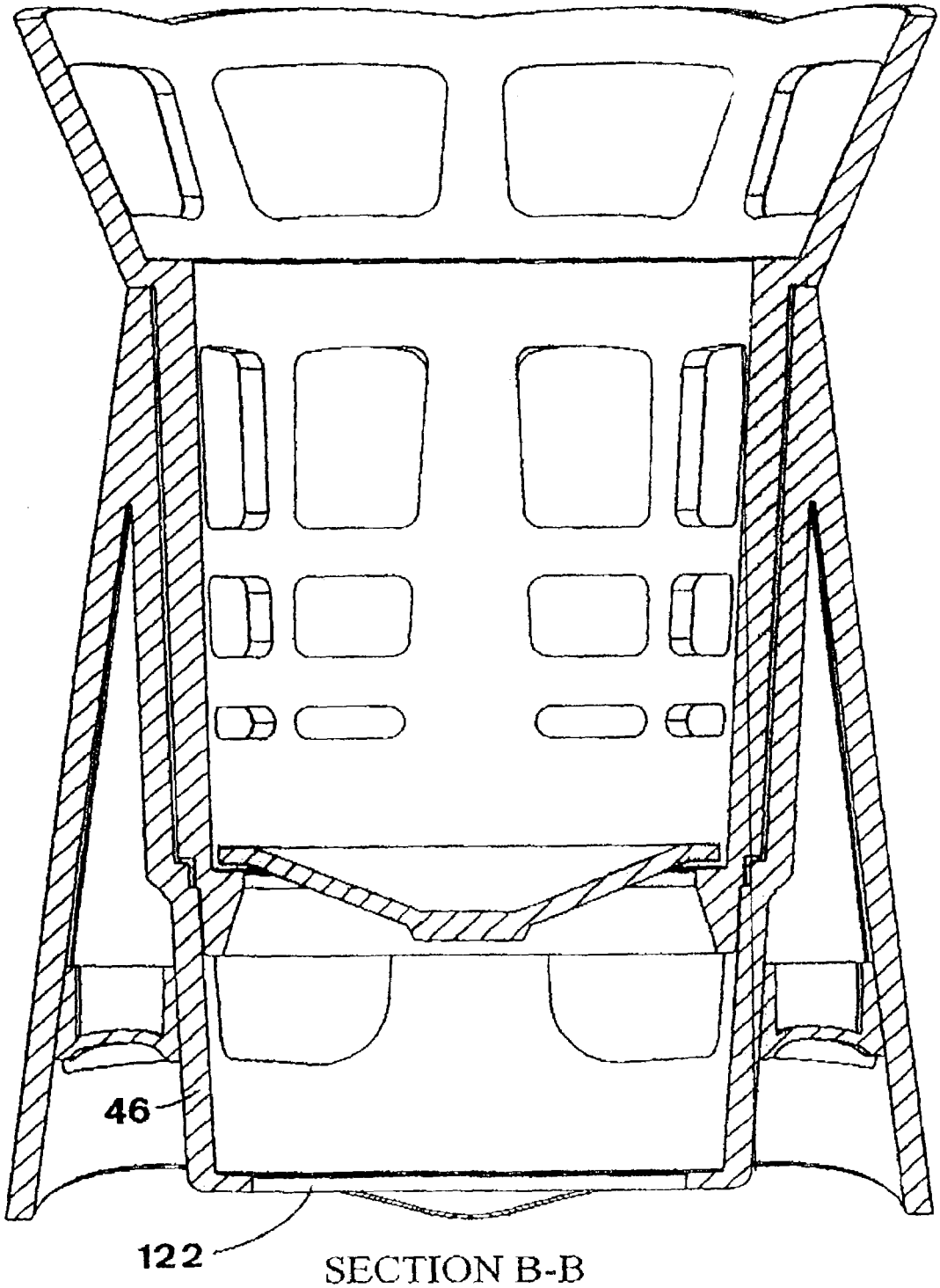

In FIG. 14 is shown still further embodiment of the apparatus. In this embodiment the support member is not provided with a cup means and instead of it an opening 122 is made in the internal wall 46. Through this opening moisture drained from the carrier member may escape outside and therefore there is no need in emptying the support member.

Figure 15:
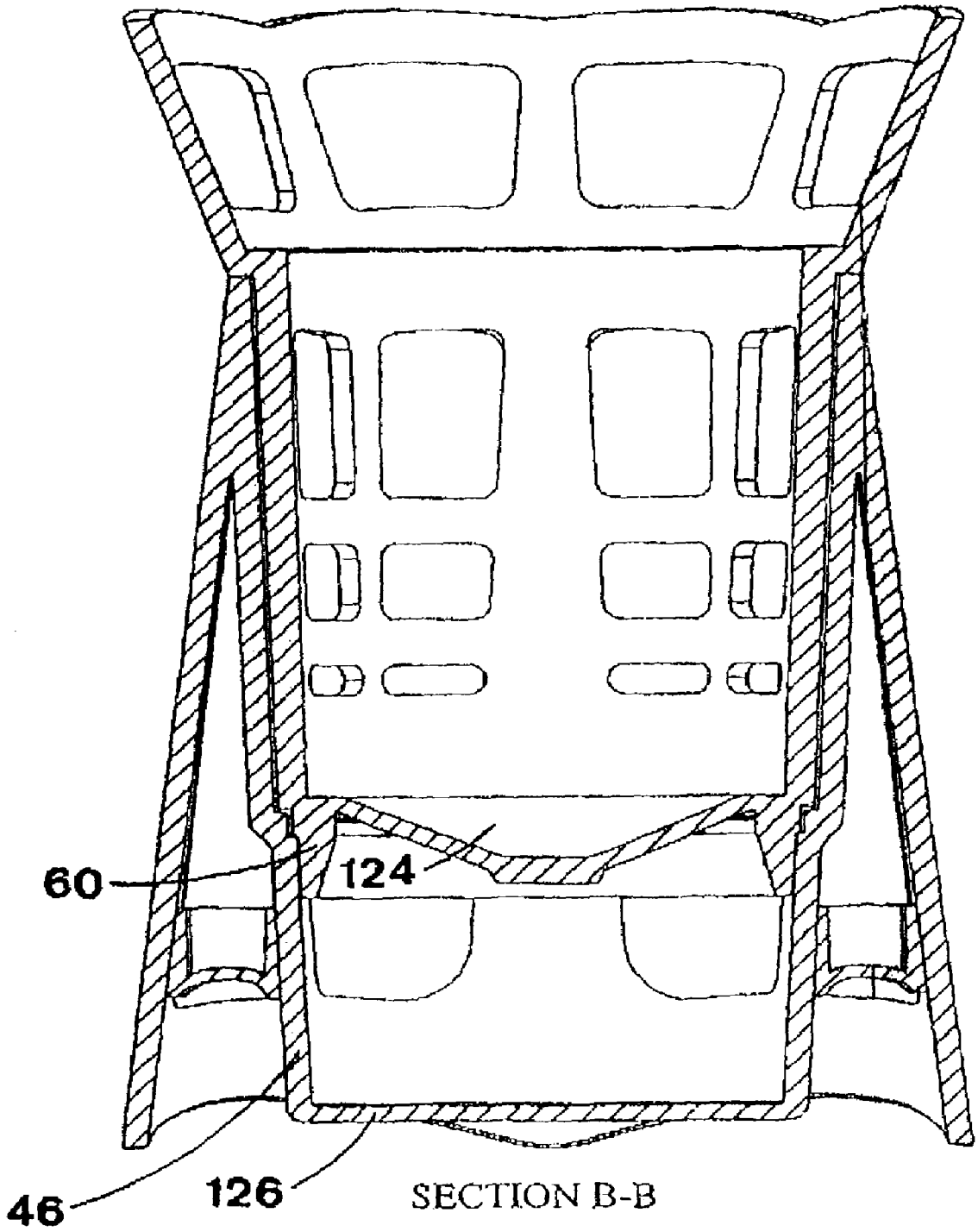
Figure 16:
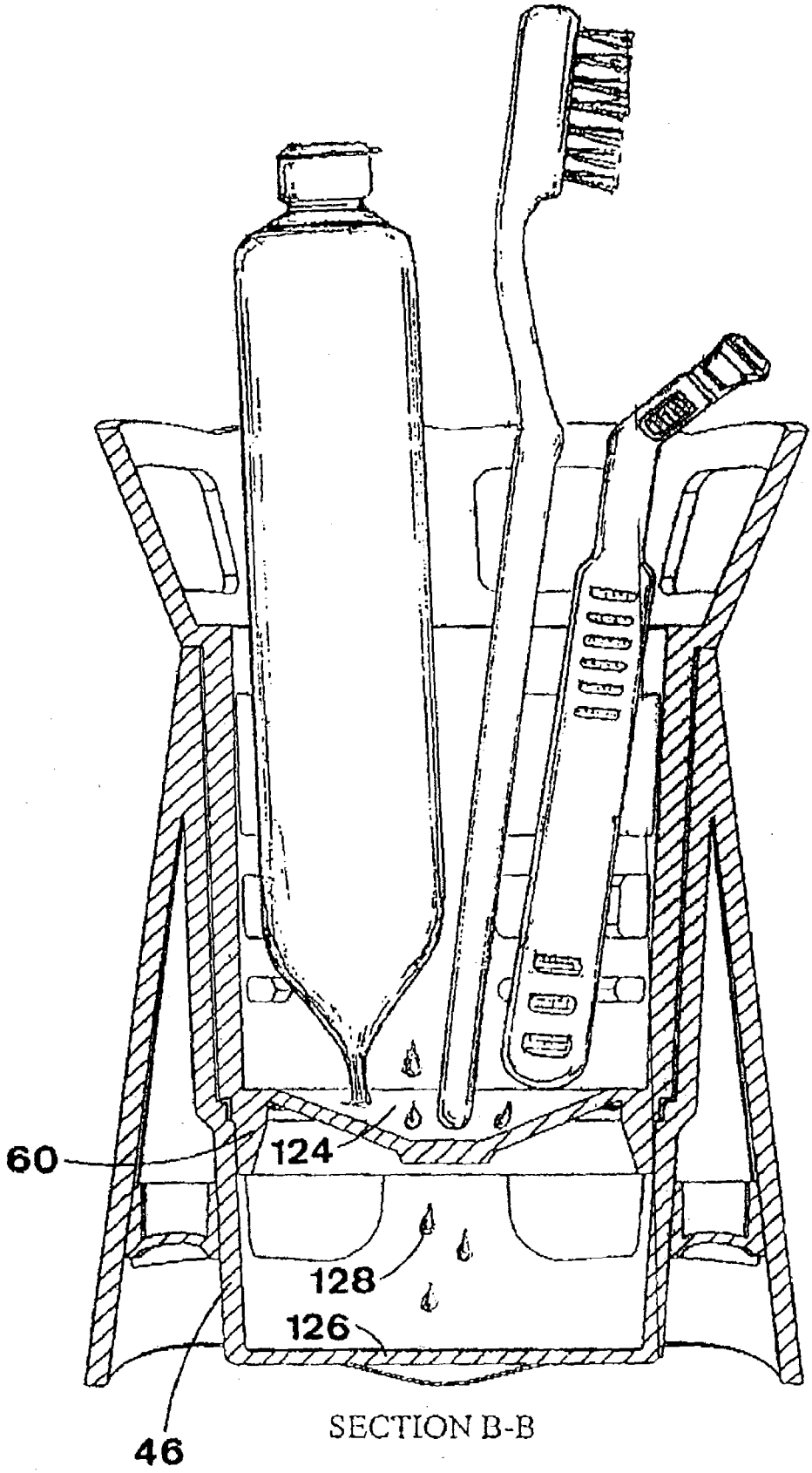

In FIG. 15 is presented an embodiment, in which the carrier member is provided with a bottom 124, which is integral with the skirt 60. The support member is provided with a floor 126, which is integral with the internal wall 46. The apparatus according to this embodiment is shown in FIG. 16 with the items stored therein. It can be seen that moisture in the form of flowing dawn droplets 128 is drained from the carrier member through its bottom 124 and is accumulated on floor 126 of the support member. To empty the support member it should be turned over after the carrier member is withdrawn therefrom.

Figure 17:
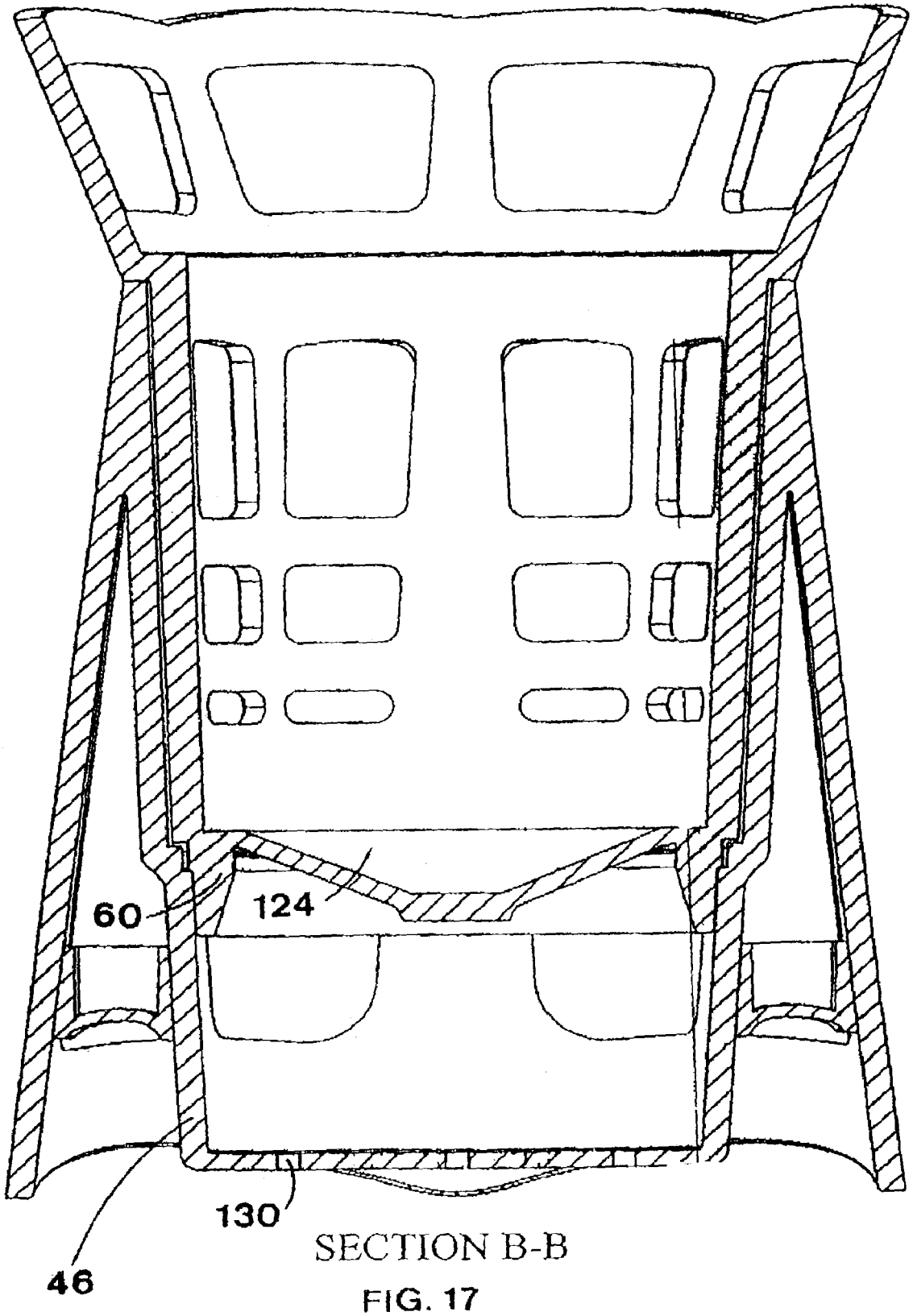

In FIG. 17 is shown yet another embodiment, which differs from the embodiment depicted in FIG. 16 only by the fact, that through openings 130 are made in the floor of the support member. Since the floor level of the inner wall 46 is above the lowermost extremities of the legs, the moisture can easy escape through the holes due to gravity.

Figure 18:
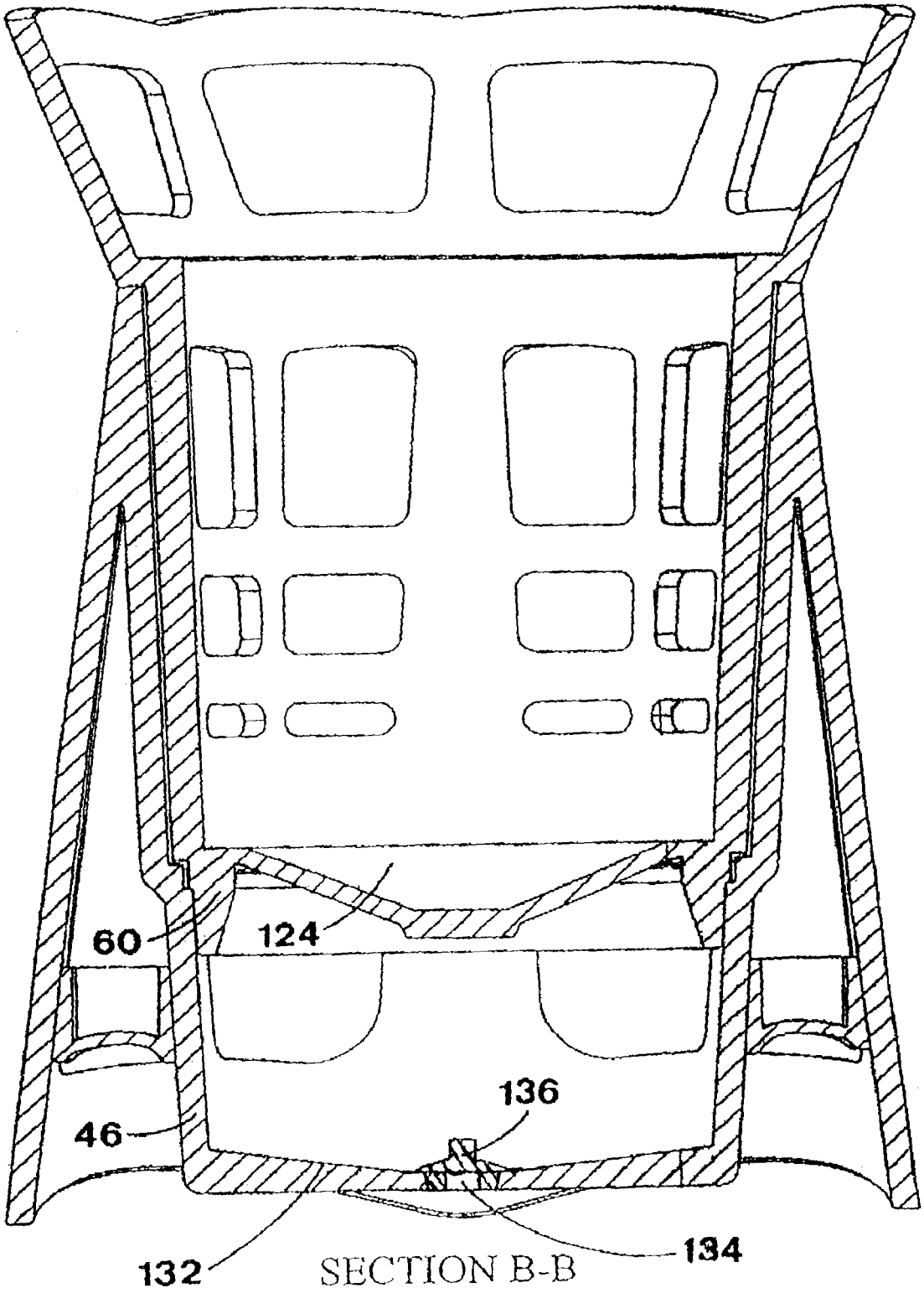

Referring now to FIG. 18 still further embodiment of the apparatus is shown. In this embodiment bottom 124 of the carrier member is integral with the skirt 60 and internal wall 46 of the support member is provided with an integral floor. However, in contrast with the previous embodiment the floor is formed with a sloped surface 132, which slopes towards the central part of the floor. Made in the center of the floor a single through opening 134 is provided, which is closed by a removable plug ring 136. By virtue of the sloped surface the moisture drained from the carrier member accumulates in the central part of the floor near the opening and it can be easily evacuated through the opening as soon as the plug ring is removed.

Figure 19:
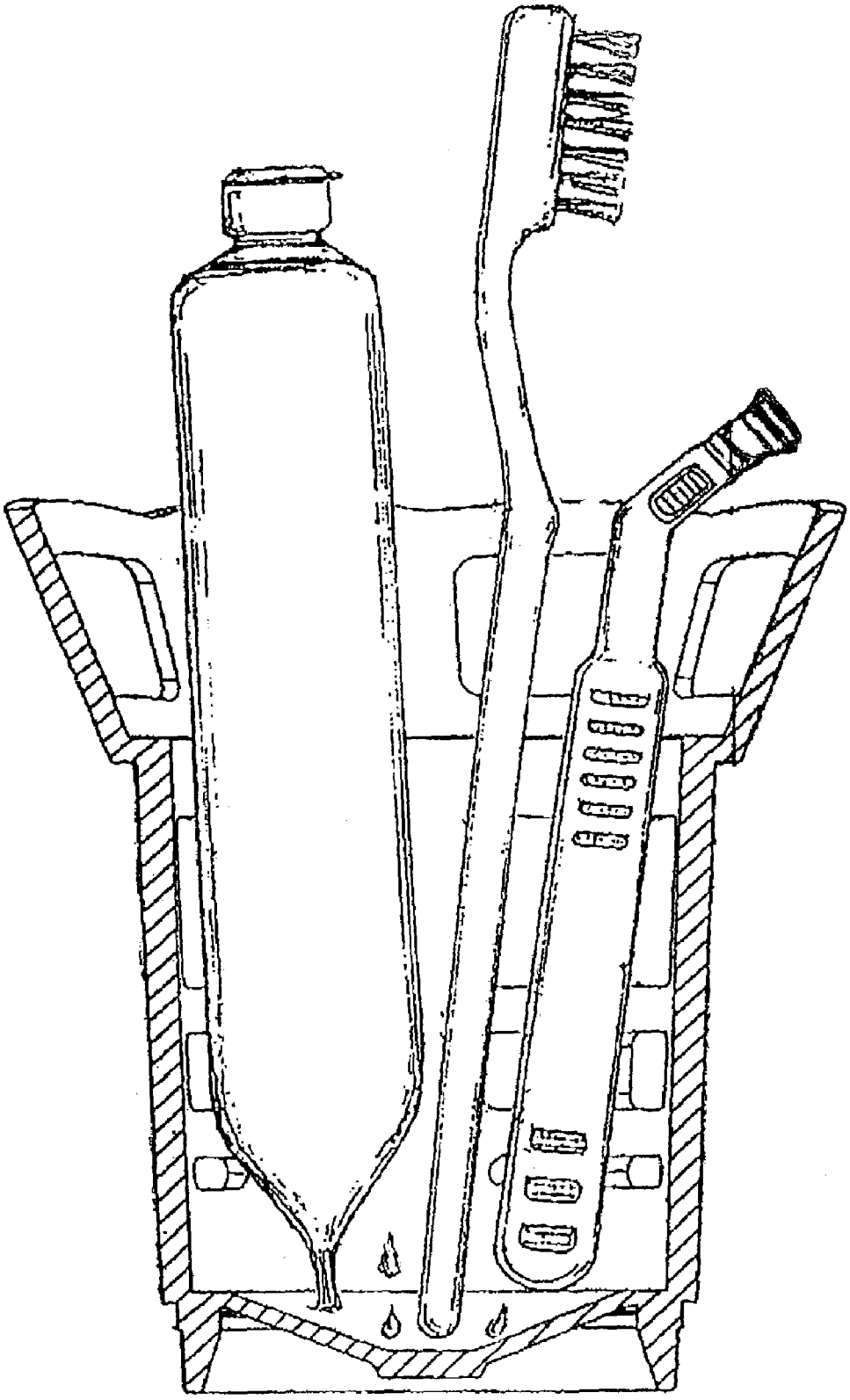
FIG. 19 is a cross-sectional view of the carrier member functioning as a standalone storage item.

Up to now the apparatus of the invention has been described as comprising two separable members provided with suitable abutment means enabling their assembling together. It should be appreciated however, that by providing the carrier member with the above-described skirt portion enabling steady positioning of the carrier member it could function as a standalone item, suitable for storage without being supported by the support member. In this embodiment the carrier member constitutes in fact a single-part apparatus for storing, which combines all the advantages of the apparatus, consisting of two parts. In particular, since the carrier member retains all the features employed in the previous embodiments it also provides sanitary and neat storage, it is convenient in use, its maintenance is simple, it is inexpensive and it has attractive appearance. Similarly to the previous embodiments the standalone carrier member can be provided either with a separate or with an integral bottom. The last possibility is depicted in FIG. 19, showing a standalone carrier member for storing toothbrush, toothpaste tube, and razor. It is seen that the stored items rest on an integral sloped bottom and that moisture accumulates in the central part of the bottom. It is not shown specifically in FIG. 19, but should be appreciated, that the bottom is provided with appropriate apertures for draining the moisture from the carrier member. Perforations in the upper portion and periphery portion are seen in FIG. 19.

In this embodiment it is advantageous if the height of the storage member is about ⅔ of the length of the items to be stored. It should be also appreciated that the standalone carrier can be provided with a separate bottom.

Figure 20:
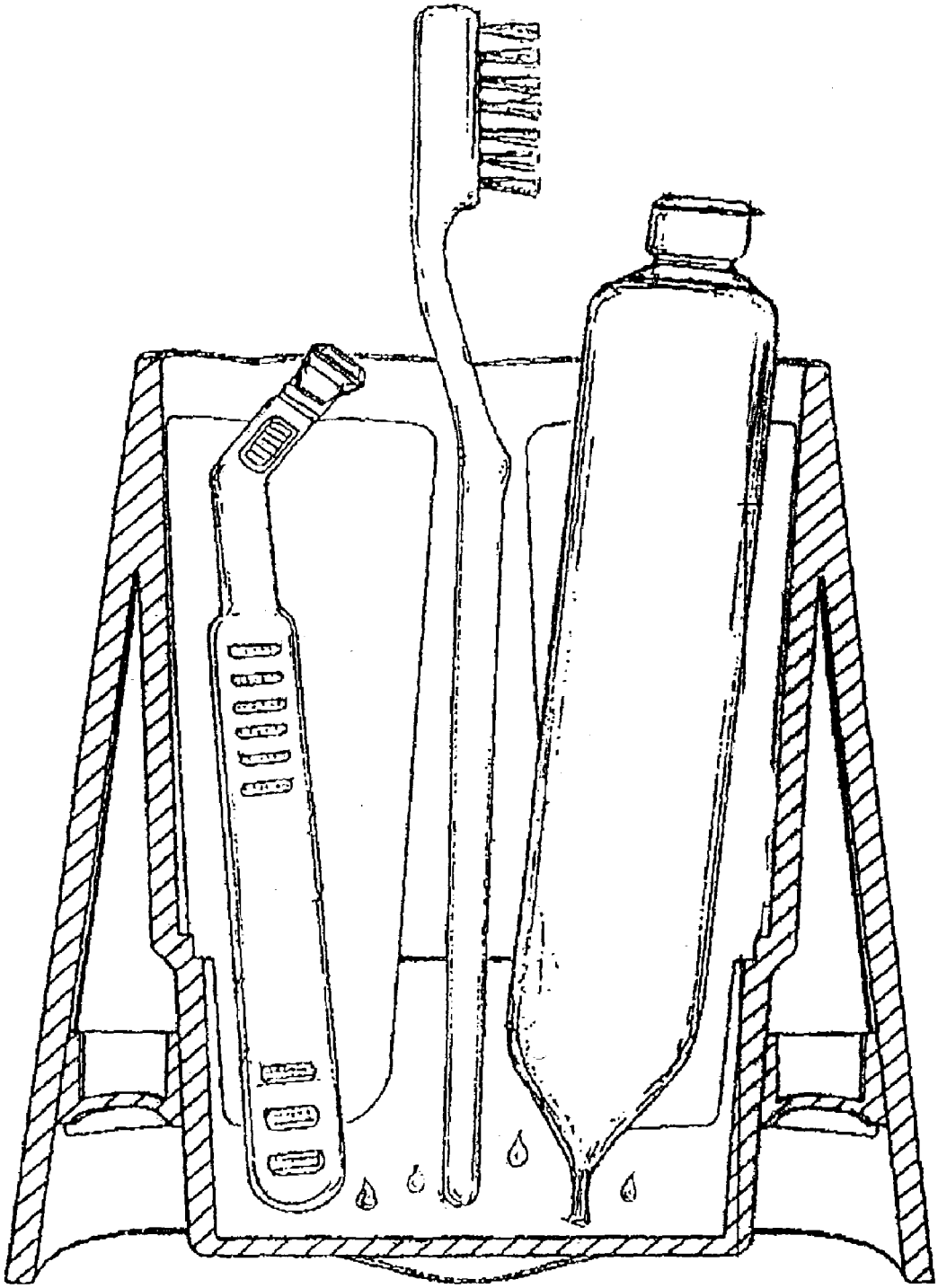
FIG. 20 is a cross-sectional view of the support member functioning as a standalone storage item.

With reference to FIG. 20 an embodiment is shown, in which the support member functions as a standalone storage means. In this embodiment the stored items rest on the floor, which is integral with the internal wall of the support member.

It should be appreciated that the present invention is not limited by the above-described embodiments and that one ordinarily skilled in the art can make changes and modifications without deviation from the scope of the invention as will be defined below in the appended claims.

For example, it is not compulsory that the carrier member and the support member are provided with dedicated means for preventing rotational displacement. If, however, such a means is desired one skilled in the art can contemplate alternative means instead of female cavities and male pins.

The carrier member can be configured as a tubular body, which is not necessarily a cylinder. The holes made in the carrier member may have configuration, which is not necessarily trapeze or rectangle.

It is not compulsory that the support member is provided with slanting legs.

The apparatus of the invention can be made of any other suitable material instead of plastic. Selection of suitable material may be dictated, inter alia, by esthetical and/or cost considerations.

In the following claims the term comprising means "including" but not limited to.

It should also be appreciated that features disclosed in the foregoing description, and/or in the foregoing drawings, and/or following claims both separately and in any combination thereof, be material for realizing the present invention in diverse forms thereof.

What is claimed is:

1. An apparatus for storing items, said apparatus comprising a carrier member adapted to accommodate the items therein and a support member adapted to support the carrier member; said carrier member is separable from the support member and receivable thereinto, said carrier member is configured as a body of rotation defined by a longitudinal axis, by an upper portion, by an elongated tubular peripheral portion and by a lower portion; said upper portion is open to enable placement of the items in the carrier member; said earner member and said support member are provided with a respective means for abutment enabling resting of the carrier member on the support member; and at least the carrier member is provided with a means for ventilation and with a means for drainage to enable sanitary storage of the items.

2. The apparatus for storing as defined in claim 1, in which said means for abutment is designed to prevent rotational displacement of the carrier member with respect to the longitudinal axis when the carrier member is received within the support member and rests thereon.

3. The apparatus for storing as defined in claim 2, in which the peripheral portion of the carrier member is configured as a cylinder, the means for abutment of the carrier member is located on the peripheral portion adjacent the lower portion, said means for abutment of the carrier member comprises an annular stepwise recess and discrete female cavities distributed along the annular recess; the means for abutment of the support member is configured as a stepwise protrusion with discrete male pins; said stepwise annular recess and said stepwise protrusion are configured and dimensioned to enable resting the carrier member on the support member and said female cavities and said male pins are dimensioned and disposed in such a manner that the pins may enter into respective cavities to secure position of the carrier member when it rests on the support member; and said means for ventilation comprises plurality of perforations made at least in the peripheral portion of the carrier member and said means for drainage comprises at least one aperture provided in the lower portion of the carrier member.

4. The apparatus as defined in claim 3, in which the upper portion of the carrier member is configured as a truncated cone tapering downwardly to adjoin the peripheral portion of the earner member with formation of an annular shelf region having an outside diameter exceeding the outside diameter of the peripheral portion and having an inside diameter mating the outside diameter of the peripheral portion; the lower portion of the carrier member is formed with a bottom for resting the stored items thereon, said lower portion is designed to enable steady positioning of the carrier member on a horizontal plane when the carrier member is separate from the support member; said support member comprising:

several legs, each of them being defined by an upper extremity, by a leg body portion and by a lower extremity, a ring-like neck portion, adjoining the upper extremities of the legs, a lowermost portion, consisting of an internal wall, adjoining the inwardly facing surfaces of the lower extremities of the legs and an external wall, which is concentric with the internal wall and which adjoins the outwardly facing surfaces of the lower extremities of the legs, several open windows provided between the legs, each of the windows being defined by the neck portion, by the leg body portions and by the external wall, wherein the stepwise protrusion and the male pins of the support member are formed on the inwardly facing surfaces of the legs and the annular shelf region of the carrier member is adapted to rest on the neck portion of the frame when the annular depression of the carrier member rests on the corresponding stepwise protrusion of the support member.

5. The apparatus as defined in claim 4, in which said bottom of the carrier member is provided with a rest surface, which tapers downwardly and towards a central part of the bottom and the said at least one aperture is made in the central part of the bottom.

6. The apparatus as defined in claim 4, in which said bottom is formed integrally with the lower portion of the carrier member.

7. The apparatus as defined in claim 4, in which said bottom is separable from the lower portion of the carrier member.

8. The apparatus as defined in claim 4, in which the lowermost portion of the support member is provided with a cup, said cup is suitable for collecting the moisture draining from the carrier member.

9. The apparatus as defined in claim 8, in which said cup is integral with the internal wall.

10. The apparatus as defined in claim 8, in which said cup is separable from the internal wall.

11. The apparatus as defined in claim 8, in which said cup is provided with at least one through going opening.

12. The apparatus as defined in claimi 1, in which said cup is provided with a single opening, which is plugged by a removable plug.

13. The apparatus as defined in claim 4, in which the annular shelf region of the carrier member and the neck portion of the support member are formed with mating engagement surfaces.

14. The apparatus as defined in claim 13, in which said engagement surfaces are undulated.

15. The apparatus as defined in claim 4, in which a lowermost gide of said external wall is configured to enable steady positioning of the support member on a horizontal plane.

16. The apparatus as defined in claim 1, said apparatus is made of a plastic material.

17. The apparatus as defined in claim 4, in which at least the support member is made of a translucent material, at least one of the legs is hollow and provided with a removable plug to enable filling the leg's interior with a colored fluid medium.

18. A carrier member, suitable for storage of items, said carrier member is configured as a body of rotation defined by a longitudinal axis, by an upper portion, by an elongated tubular peripheral portion and by a lower portion, said upper portion is open to enable placement of the items in the carrier member and is configured as a truncated cone tapering downwardly to adjoin the peripheral portion; the lower portion of the carrier member is provided with a bottom for resting the stored items thereon and it is designed to enable steady positioning of the carrier member on a horizontal plane; said carrier member is provided with a means for ventilation and with a means for drainage to enable sanitary storage of the items.

19. A support member suitable for storing items, said support member is configured as a body of rotation comprising several legs, each of them being defined by an upper extremity, by a leg body portion and by a lower extremity a ring-like neck portion, adjoining the upper extremities of the legs, a lowermost portion, consisting of an internal wall, adjoining the inwardly facing surfaces of the legs lower extremities and an external wall, which is concentric with the internal wall and which adjoins the outwardly facing surfaces of the legs lower extremities, said lowermost portion is designed to enable steady positioning of the support member on a horizontal plane, a cup providing a floor for resting the stored items thereon, said cup is suitable for collecting moisture associated with the items and said cup is provided with a means for drainage to enable sanitary storage of the items.

* * * * *